US007494235B2

(12) United States Patent
Floyd, Jr.

(10) Patent No.: US 7,494,235 B2
(45) Date of Patent: Feb. 24, 2009

(54) DOCUMENT ILLUMINATOR

(76) Inventor: Franklin B. Floyd, Jr., 2723 Dryden Rd., Shaker Heights, OH (US) 44122

( * ) Notice: Subject to any disclaimer, the term of this patent is extended or adjusted under 35 U.S.C. 154(b) by 127 days.

(21) Appl. No.: 11/745,183

(22) Filed: May 7, 2007

(65) Prior Publication Data

US 2007/0258245 A1 Nov. 8, 2007

Related U.S. Application Data

(60) Provisional application No. 60/798,043, filed on May 5, 2006.

(51) Int. Cl.
*F21V 33/00* (2006.01)

(52) U.S. Cl. ..... 362/99; 362/98; 362/234

(58) Field of Classification Search ..... 362/98, 362/99, 227, 84, 234, 276
See application file for complete search history.

(56) References Cited

U.S. PATENT DOCUMENTS

| | | | | |
|---|---|---|---|---|
| 4,969,068 | A | 11/1990 | Williams | |
| 5,639,156 | A | 6/1997 | Broxson | |
| 5,791,802 | A | 8/1998 | Englum | |
| 6,637,907 | B1 | 10/2003 | Levy | |
| 7,128,433 | B2 | 10/2006 | Schlosser | |
| 2002/0030989 | A1 | 3/2002 | Stephen | |
| 2002/0131263 | A1 * | 9/2002 | Naghi et al. | 362/98 |
| 2004/0244246 | A1 * | 12/2004 | Smith et al. | 40/544 |
| 2006/0232953 | A1 * | 10/2006 | Sanders | 362/98 |
| 2007/0115650 | A1 * | 5/2007 | Cohan et al. | 362/99 |
| 2007/0223211 | A1 * | 9/2007 | Jeffrey et al. | 362/98 |

* cited by examiner

*Primary Examiner*—Sandra L. O'Shea
*Assistant Examiner*—Meghan K. Dunwiddie

(57) ABSTRACT

A document illuminator includes first and second cover portions, first and second illumination sources, and a power source. The first and second cover portions are connected and foldable along a spine portion. The first and second illumination sources are secured to a corresponding one of the first and second cover portions. The power source is electrically connected to the first and second illumination sources to selectively power the first and second illumination sources when a power switch is activated. When first and second translucent documents are secured to corresponding ones of the first and second cover portions and power is supplied to the first and second illumination sources, each of the first and second illumination sources direct illumination through a corresponding one of the first and second translucent documents.

19 Claims, 7 Drawing Sheets

DOCUMENT ILLUMINATOR

CROSS REFERENCE TO RELATED APPLICATION

This application claims the benefit of U.S. patent application Ser. No. 60/798,043, entitled "DOCUMENT ILLUMINATOR" and filed May 5, 2006, the entire contents of which are incorporated herein by reference, to the extent that they are not conflicting with the present application.

BACKGROUND

Viewing a document in an unlit or dimly lit environment can be challenging. Many environments are intentionally unlit or dimly lit. For example, a movie theater may be unlit to limit interference with the viewing of a movie projected onto a screen. In another example, a restaurant may be dimly lit to create a pleasant ambiance and enhance a dining experience. In an unlit movie theater, an usher may be required to refer to written material, such as seating arrangements or safety procedures. In a dimly lit restaurant, a diner may be required to make selections from a menu or wine list in the course of ordering dinner.

SUMMARY

The present application contemplates providing a localized light source integral with a portable document display, such as, for example, a restaurant menu or a theater program or playbill, in order to illuminate a document for viewing in an environment having insufficient ambient light. According to one inventive aspect of the present application, backlighting is provided for directing illumination from an illumination source through a translucent document that is attached to a frame or cover portion of a document illuminator.

Accordingly, in one exemplary embodiment, a document illuminator includes first and second cover portions, first and second illumination sources, and a power source. The first and second cover portions are connected along a spine portion, and are foldable such that a first display surface of the first cover portion faces a second display surface of the second cover portion when the document illuminator is in a closed position. The first and second illumination sources are secured to a corresponding one of the first and second display surfaces. The power source is disposed along the spine portion, and is electrically connected to the first and second illumination sources to selectively power the first and second illumination sources when a power switch is activated. When first and second translucent documents are secured to corresponding ones of the first and second display surfaces and power is supplied to the first and second illumination sources, each of the first and second illumination sources direct illumination through a corresponding one of the first and second translucent documents.

DESCRIPTION OF THE DRAWINGS

Features and advantages of the invention will become apparent from the following detailed description made with reference to the accompanying drawings, wherein.

DETAILED DESCRIPTION

This Detailed Description of the Invention merely describes embodiments of the invention and is not intended to limit the scope of the invention in any way. Indeed, the invention as described is broader than and unlimited by the preferred embodiments, and the terms used have their full ordinary meaning.

When viewing media inscribed with information, such as, for example, a printed document, in an unlit or dimly lit environment, illuminating the document with a localized light source can enhance a viewer's ability to see the information contained in or inscribed on the document. Illumination may come in many forms, for instance, a light source suspended above the document or a light source positioned behind the document (i.e., backlighting). According to an inventive aspect of the present application, backlighting integral with a portable document holder may be used to enhance the viewing of a document.

Figure 1:
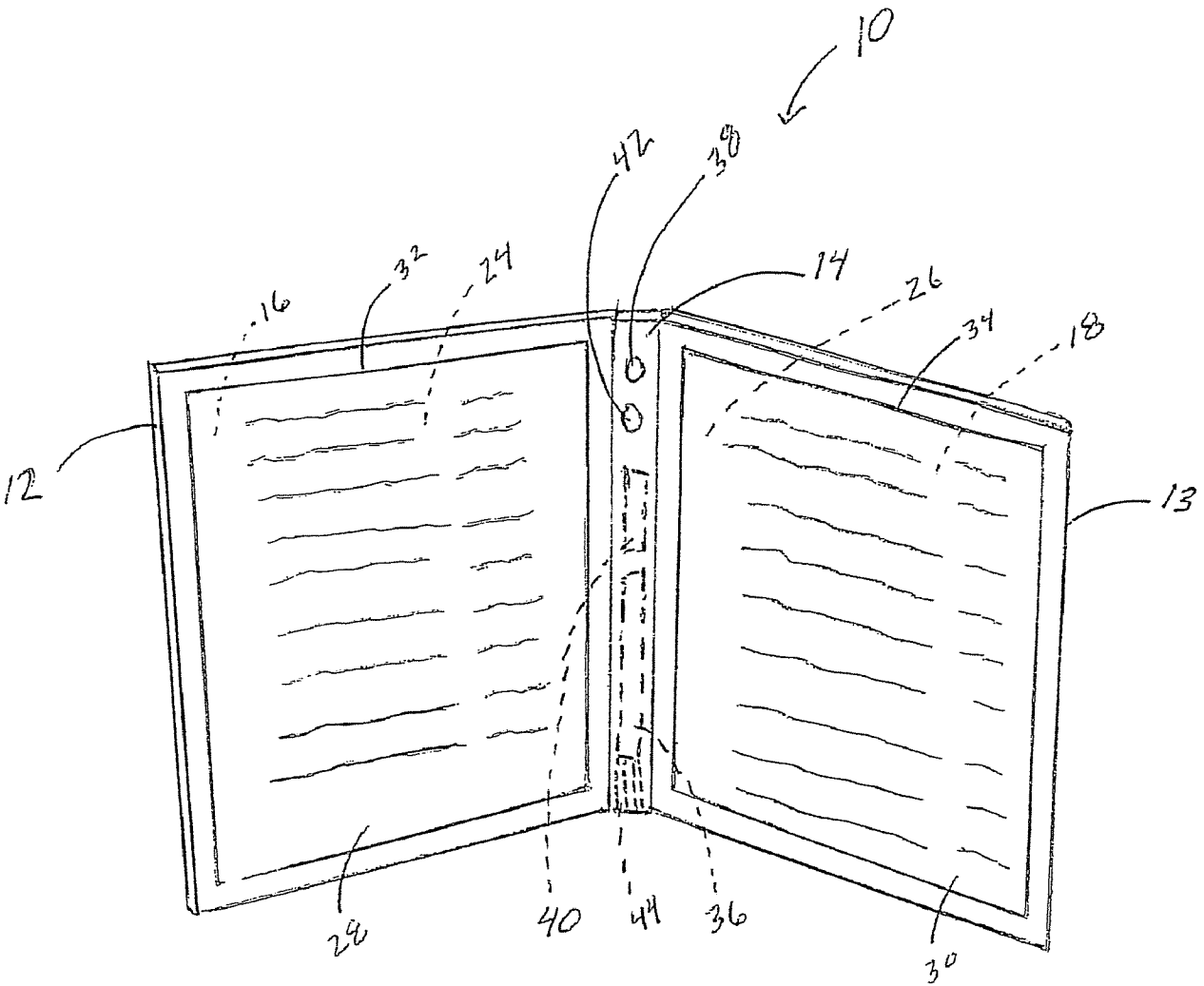
FIG. 1 is a perspective view of a document illuminator with a document secured to the document illuminator.
Figure 2:
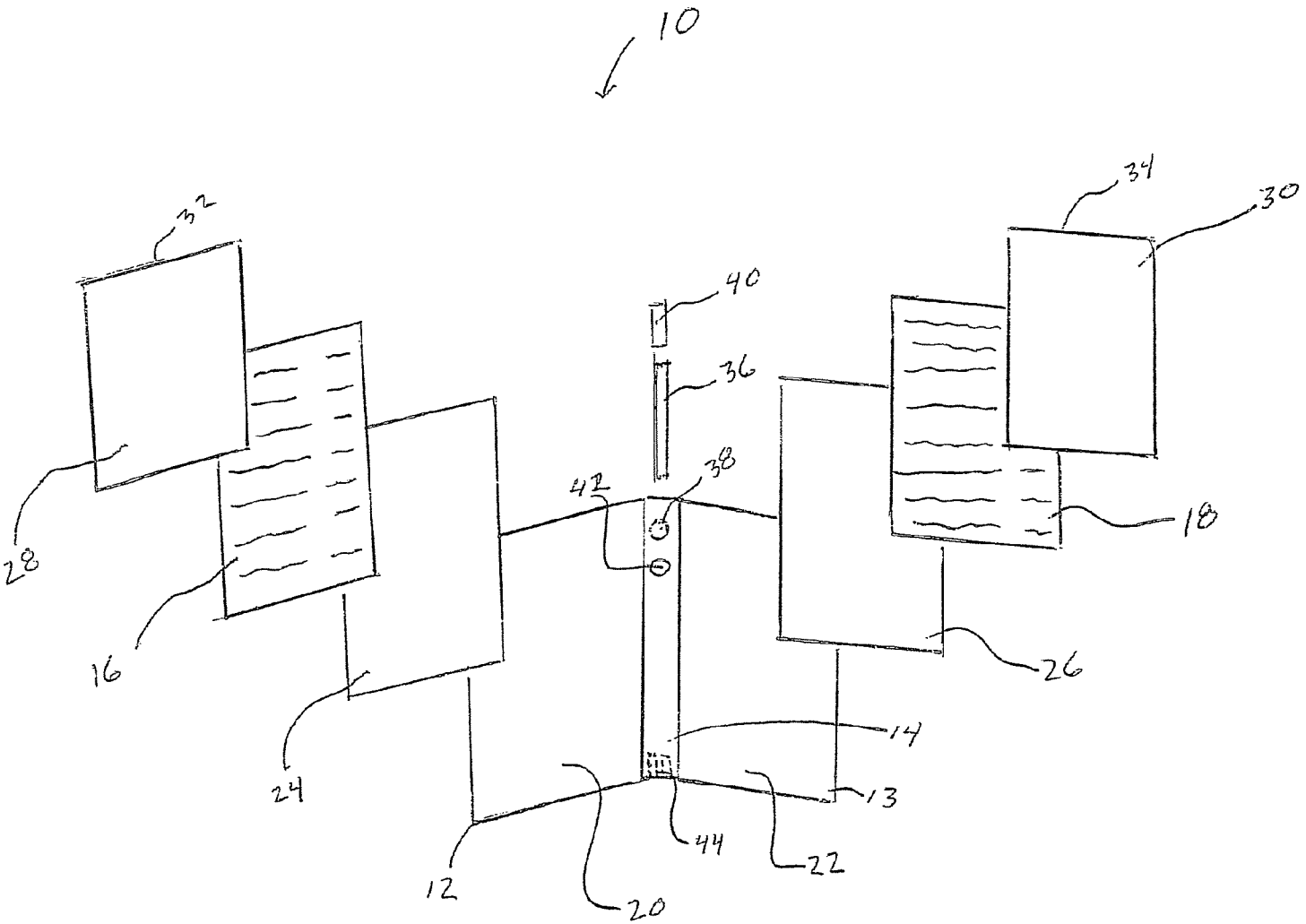
FIG. 2 is an exploded view of the document illuminator of FIG. 1.

Backlighting may provide advantages over other types of illumination intended to facilitate viewing of a document. For example, backlighting may use very low levels of illumination, since the light is primarily or exclusively directed towards the user and through the document, which may be translucent to allow for passage of light. As a result, these low levels of illumination may require lower power, and may be less distracting to others in an environment that is intentionally kept dark or dimly lit. For example, the reading of a playbill or program at a play, opera or orchestra performance can be enhanced by the inclusion of backlighting of the printed material. FIGS. 1 and 2 illustrate an exemplary device in accordance with some of the inventive aspects of the present application, using backlighting to enhance a viewer's ability to view a document in a reduced light environment.

FIGS. 1 and 2 illustrate a portable document illuminator 10 designed for facilitating reading of a two sheet menu in a dimly lit restaurant. The document illuminator 10, as described, includes a front cover portion 12 and a back cover portion 13 joined by a binder or spine portion 14 and foldable between closed and open positions (for example, similar to a conventional restaurant menu). When the front cover 12 is opened, opposed display surfaces holding translucent paper sheets 16 and 18 are revealed. The exemplary sheets 16 and 18 may contain, for example, a list of items from which a restaurant customer can select while ordering dinner. Document illuminator 10 utilizes backlighting to allow the customer to more easily read and interpret items listed on the sheets 16 and 18. It will be understood, therefore, that paper sheets 16 and 18 are sufficiently translucent (and may, for example, be transparent) to allow at least some of the light generated by illumination sources 24 and 26, as further described below, to pass through these paper sheets for illuminating the list contain on these sheets.

As best seen in FIG. 2, the front cover 12 and back cover 13 each include an inner mounting or display surface 20 and 22, respectively. A pair of illumination sources 24 and 26 are mounted on the inner mounting surfaces 20 and 22. A pair of clear or transparent sheets 28 and 30 are secured over the illumination sources 24 and 28. The clear sheets 24 and 26 can be plastic or any other generally transparent material. In the described embodiment, the clear sheets 28 and 30 are secured to the inner mounting surfaces 20 and 22 along three edges, leaving the top edges 32 and 34 unsecured. In this arrangement the illuminating sources 24 and 26 and the clear sheets 28 and 30 form a pair of envelopes or sleeves into which the paper sheets 16 and 18 are inserted. The sleeves secure the paper sheets 16 and 18 and allow the user (e.g., a restaurant customer) to view the paper sheets 16 and 18 though the clear sleeves 28 and 30. The illumination sources 24 and 26 produce light that passes through the paper sheets 16 and 18 and assists the customer in reading items listed on the sheets 16 and 18. Because the paper sheets 16 and 18 are attached to the exemplary menu 10 by being inserted into the sleeves, the paper sheets 16 and 18 can be easily removed and replaced with updated or edited sheets of paper, thus facilitating menu or pricing changes (for example, to change from a lunch menu to a dinner menu).

Alternatively, the use of clear sheets 28 and 30 can be eliminated, and documents may be secured over the illumination sources 24, 26 by another mechanism or configuration. For example, the paper sheets 16 and 18 can be attached to the menu 10 by four corner tabs (not shown), through light adhesives, or through any other method that secures the sheets 16 and 18 to the menu 10. In yet another alternative, the paper sheets can be eliminated and the list of dinner items can be printed directly on the illumination sources 24 and 26.

In the illustrated example, the light sources 24 and 26 are electroluminescent lamps arranged in panels or films. The panels 24 and 26 may be approximately the size of the paper sheets 16 and 18 to provide uniform illumination over the entire document. Electroluminescent panels offer a thin, flexible, and durable source of light. Typical, electroluminescent panels are approximately 0.3 mm in thickness and can be manufactured with thicknesses of less than 0.1 mm. The exemplary electroluminescent panels 24 and 26 are mounted to the inner mounting surfaces 20 and 22 using adhesives. Alternatively, the electroluminescent panels 24 and 26 can be secured to the inner mounting surfaces 20 and 22 through a number of methods. For example, fasteners, such as screws or clips (not shown), can be used to secure the panels 24 and 26 to the menu 10. This arrangement can facilitate the removal of the panels 24 and 26 for service and maintenance purposes. Many different types of electroluminescent lamps may be used. As one example, a document illuminator may be provided with QUANTAFLEX 1600™ electroluminescent lamps.

The illumination sources may be powered by many different types of power sources, including, for example, connection to a wall outlet by an electrical cable, or a portable power source, such as a battery, secured to the document illuminator 10. The exemplary electroluminescent panels 24 and 26 are powered by a battery 36 positioned within the spine portion 14 of the menu 10. The binder 14 may also include an inverter, transformer, and wiring (not shown) to place the battery 36 in electrical communication with the electroluminescent panels 24 and 26. An on/off or power switch 38 can be incorporated into the document illuminator 10 (for example, in the spine portion 14 or along an outer edge of one of the cover portions) to allow the viewer to selectively power the illumination sources to illuminate the menu 10 only when needed, thereby reducing power consumption. While the power switch may be manually operable by the user, in another embodiment, the power switch may be positioned in the spine portion 14 such that the switch 38 is automatically activated with the document illuminator 10 is opened, and automatically deactivated with the document illuminator is closed, thereby preventing the power from being left on inadvertently.

A dimmer switch 40, which may include a rheostat, variable resistor, or other such variable device, may be provided on the document illuminator 10 (for example, in the binder 14 or along an outer edge of one of the cover portions) to control the brightness of the illumination. A controller 42, wired to the rheostat 40, can be included to allow the viewer to adjust the intensity of the illumination of the menu 10. In one such embodiment, the dimmer switch is configured to adjust resistance, such that a voltage range of approximately 2.5 VDC to 9 VDC is supplied to the electroluminescent panels 24, 26. While many ranges of illumination intensity may be provided, in one embodiment, illumination intensity may be limited to a maximum of approximately 20 candelas per square meter, to limit power consumption and/or to reduce distraction to other individuals in an intentionally darkened or dimly lit area. In one example, a dimmer switch allows for an illumination intensity range of approximately 10-20 candelas per square meter. While light may be provided at a wide range of frequencies, in one embodiment, frequency is limited to a range of approximately 50-60 Hz. Although the illustrated embodiment shows and describes the on/off switch 38 and the rheostat controller 42 as located on the binder 14, the switch 38 and controller 42 can alternatively be located anywhere that provides the restaurant customer with access to the switch 38 and control 42.

Optionally, the battery 36 may be rechargeable. Rechargeable batteries 36, may reduce the need to replace the battery, while allowing for minimization of the size of the battery required to supply power for illuminating the documents. By minimizing the size of the battery, the document illuminator 10 may be made less bulky, for example, to be consistent with a standard restaurant menu. Since menus, theater programs, or other such documents are only viewed for short periods of time, a very small battery with a very limited charge (for example, a battery with a charge capacity sufficient to provide continuous illumination for only two hours, or even less) may be used to power the electroluminescent panels 24, 26 for one individual's viewing of the document. When that user is finished using the menu, program, or other such document (e.g., once a diner has placed his order, or once a theater performance has concluded, the battery 36 may be recharged for a subsequent user.

The spine portion 14 may include a plug connection 44 that allows the battery or batteries 36 to be recharged without removing the batteries 36 from the binding 14. The plug connection can be arranged such that the menu 10 can be connected to a power cord or seated into a recharger (not shown) in order to recharge the batteries 36. Alternatively, the batteries 36 can be removed from the binder 14 and recharged.

An exemplary method utilizing the embodiment illustrated in FIG. 1 and FIG. 2 is now described. At the end of a business day, backlit menus 10 are placed on battery recharging holders (not shown). Management of a restaurant selects the dinner menu choices for the next day. Those choices are printed onto two sheets of translucent paper 16 and 18 and the sheets 16 and 18 are inserted into the sleeves formed by the clear plastic sheets 28 and 30 over the electroluminescent panels 24 and 26. Upon the start of the next business day, a menu 10 is removed from the holder and presented to a dining customer. The dining customer illuminates the menu 10 by activating the power switch 38 (either by manually depressing a switch or by automatically activating the switch upon opening the menu) and adjusts the menu 10 to a desired brightness with the dimmer switch 40. The dining customer views the menu items, makes selections, and relays those selections to a waiter. The waiter collects the menu 10 and places the menu 10 back onto the holder to recharge the battery 36.

Figure 3:
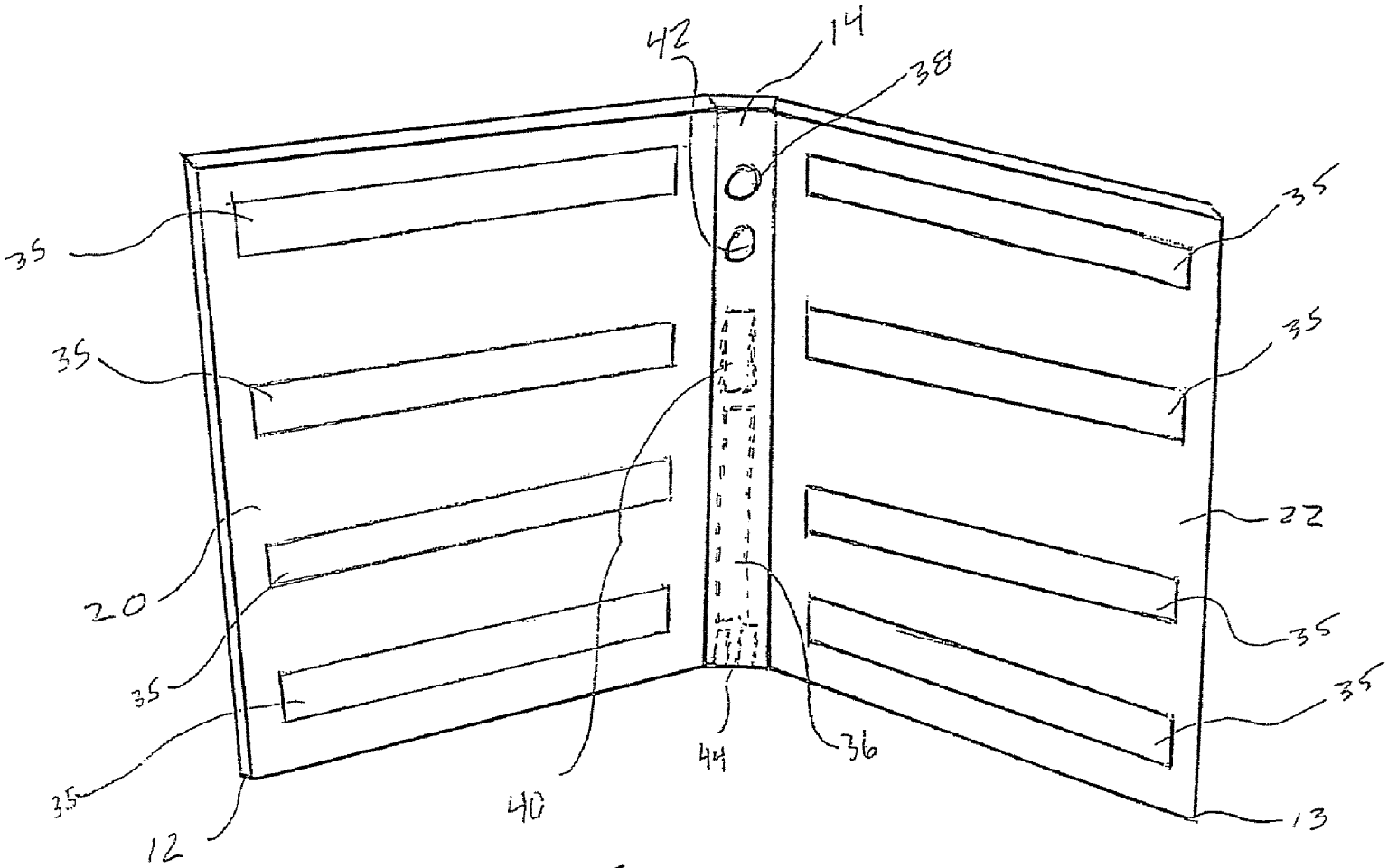
FIG. 3 is a perspective view of a document illuminator with electroluminescent panels positioned in horizontal rows on opposed display surfaces.
Figure 4:
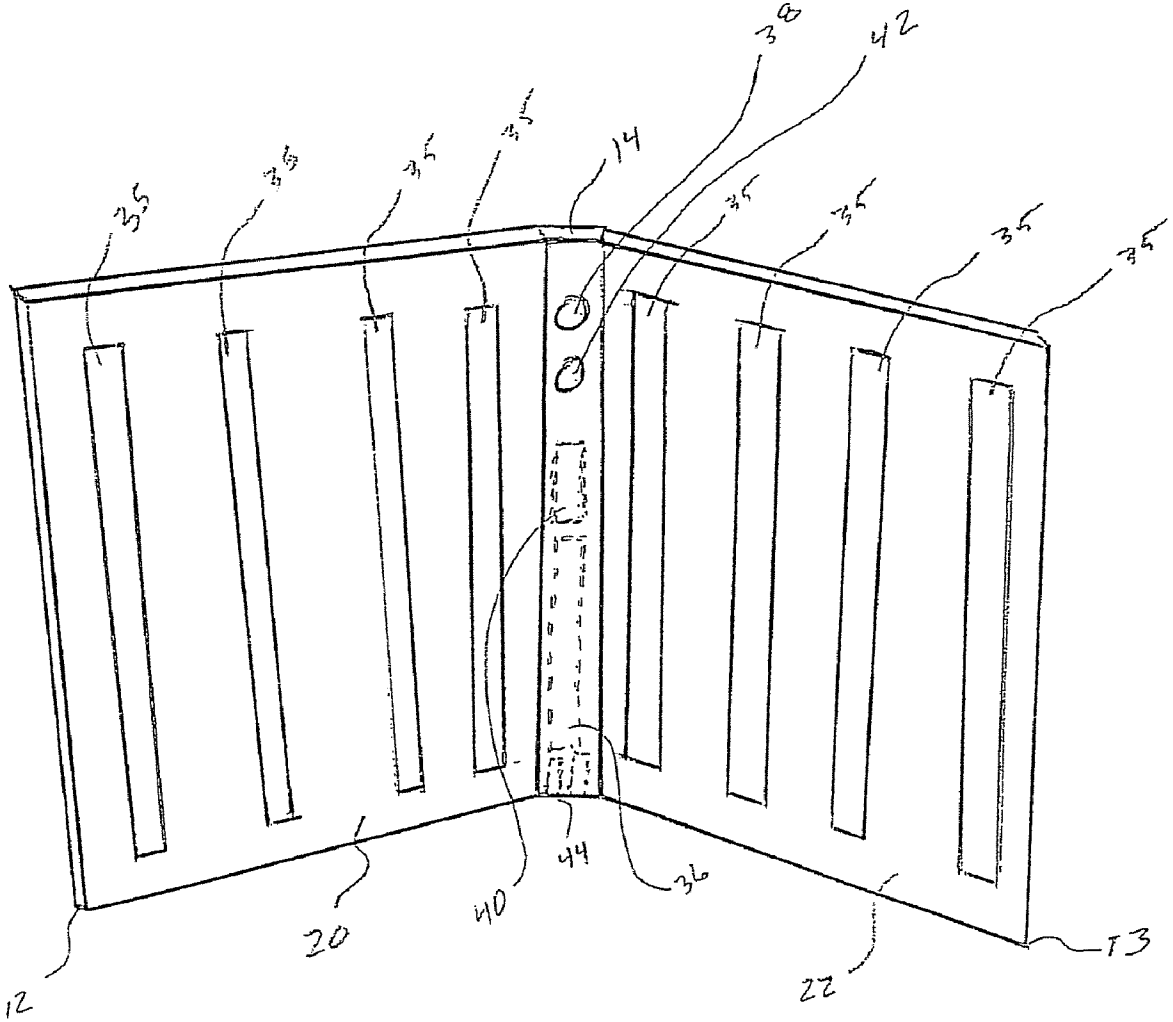
FIG. 4 is a perspective view of a document illuminator with electroluminescent panels positioned in vertical columns on opposed display surfaces.
Figure 5:
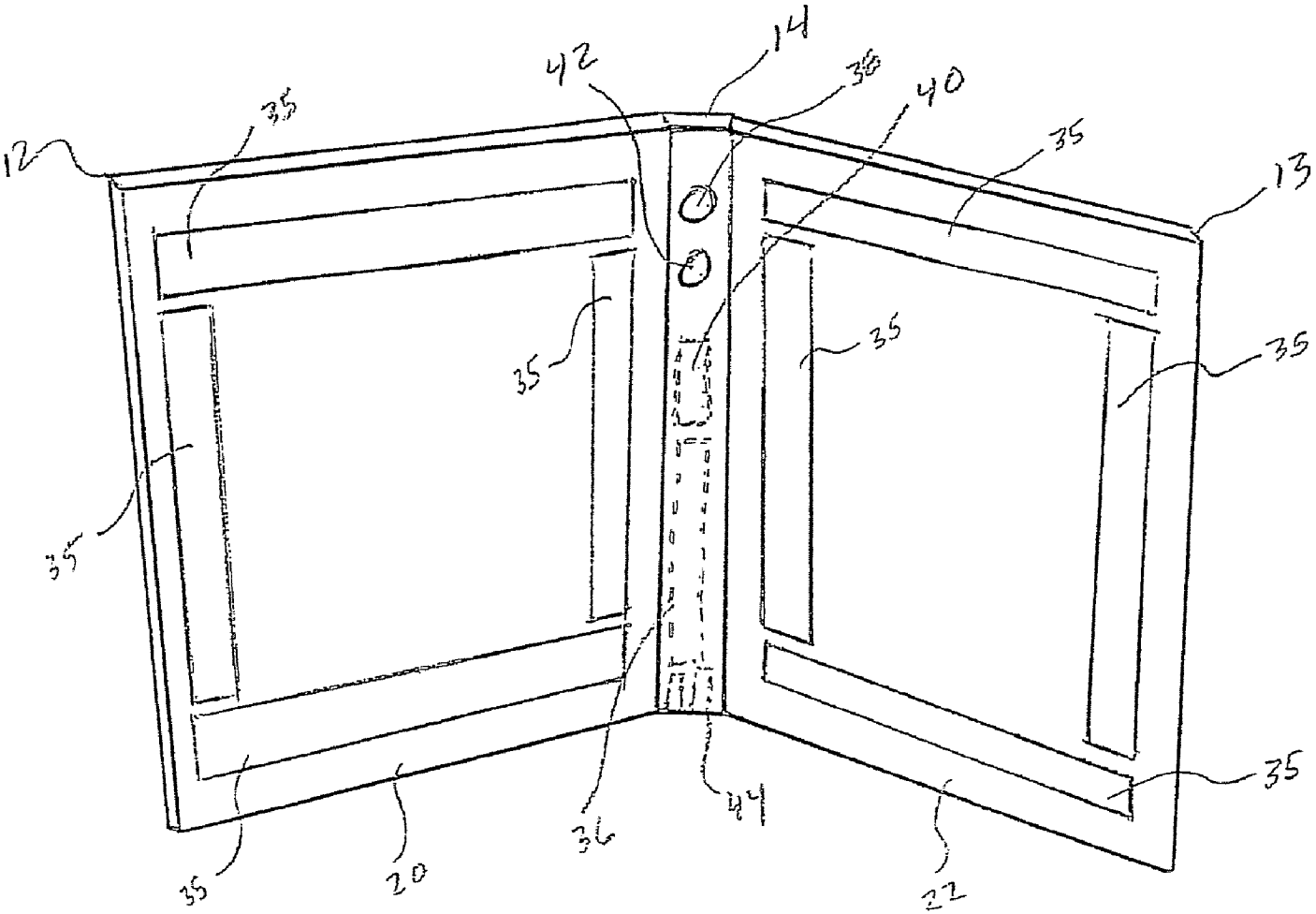
FIG. 5 is a perspective view of a document illuminator with electroluminescent panels positioned around perimeters of opposed display surfaces.

Alternatively, the electroluminescent panels 24 and 26 may be arranged in other configurations. For example, several thin electroluminescent panels or strips 35 can be mounting onto each inner mounting surface 20 and 22. As shown in FIGS. 3 and 4, a plurality of electroluminescent strips 35 can be positioned intermittently in rows or columns to provide illumination across the menu. In another embodiment, as shown in FIG. 5, electroluminescent strips 35 can be positioned along the perimeter of the mounting surfaces 20 and 22 to form a frame to illuminate the menu.

Figure 6:
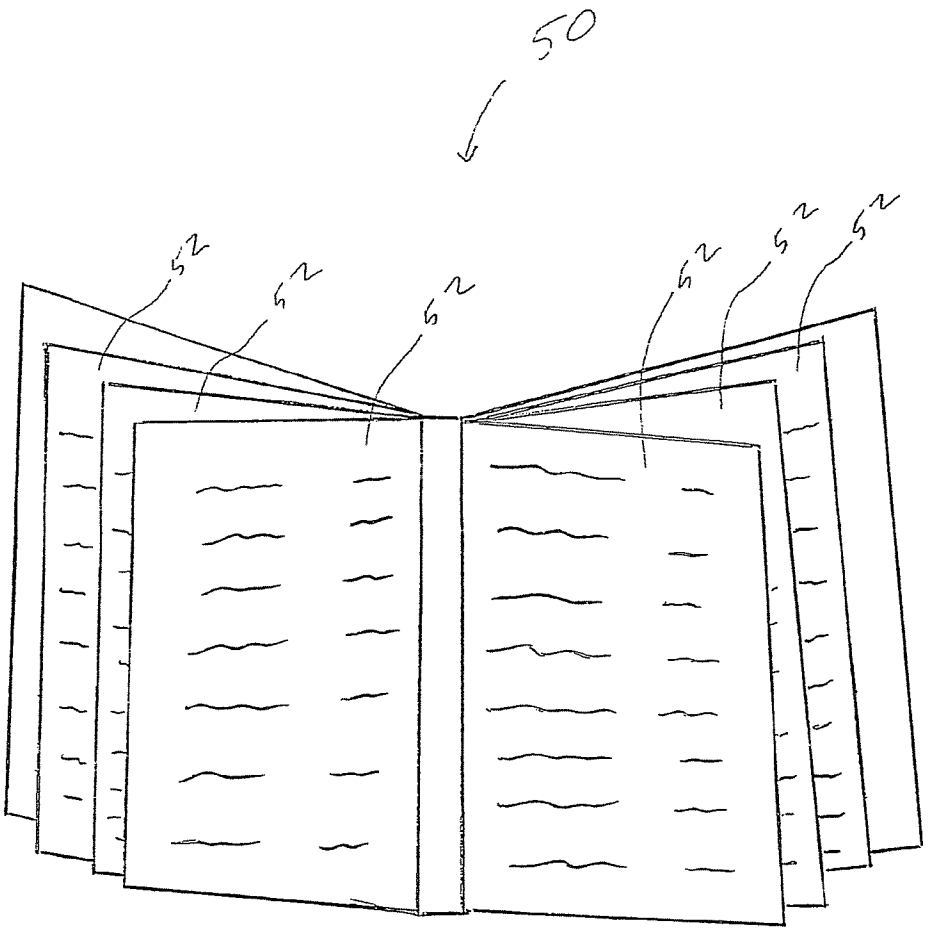
FIG. 6 is perspective view of a document illuminator having an internal illuminating page.

A document illuminator may additionally or alternatively include internal pages or page portions providing illumination to documents on one or both sides of the page. FIG. 6 illustrates one such embodiment, in which a document illuminator 50 includes a plurality of pages 52, similar to a book. Each page 52 in the menu 50 may be arranged such that written information is included on one or both sides of the page 52. Such menus 50 with double-sided pages 52 may allow a restaurant or other such establishment to illuminate several sheets of information in one compact display.

Figure 7:
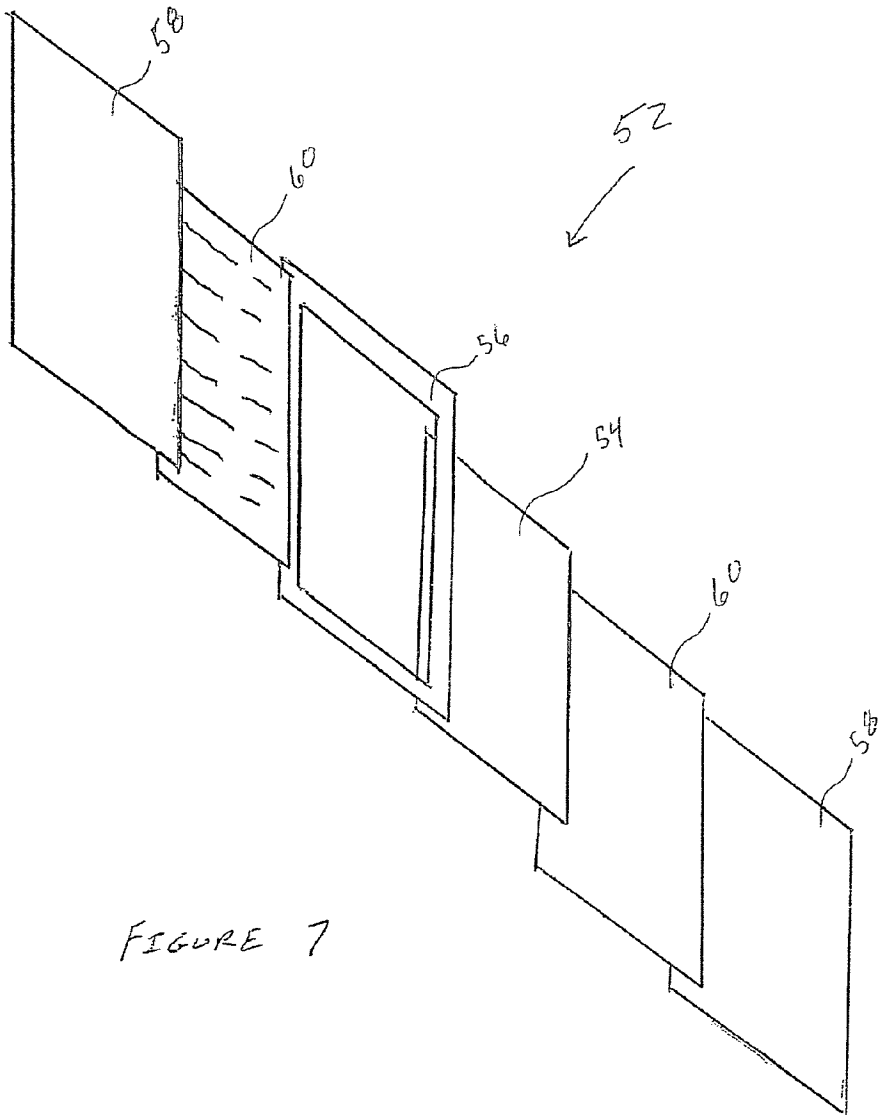
FIG. 7 is an exploded view of an illuminating page of the document illuminator of FIG. 6.

FIG. 7 shows an exploded view of an exemplary double-sided page 52. In the exemplary embodiment, each page 52 include a double-sided electroluminescent panel or film 54. The panel 54 is coupled to and supported by a frame 56. The panel 54 can be coupled to the frame by adhesives, fasteners, or any other method that secures the panel 54 to the frame 56. Alternatively, the panel 54 can be captured between two matching frame components (not shown). The frame 56 can be eliminated and a panel can be designed to provide structural integrity. For instance, a panel can be designed with reinforcement members positioned within the panel.

Similar to previous descriptions, clear sheets 58 can be attached to the electroluminescent panel 54 or frame 56. The clear sheets 58 can be attached on three edges, leaving one edge unsecured, to form envelopes or sleeves in which paper sheets 60 can be secured in the page 52. The paper sheets 60 can include printed information that can be viewed through the clear sheets 58. Alternatively, paper sheets 60 can be attached directly to the panel 54 with light adhesives or double-sided tape, thus eliminating the clear sheets 58. This attachment can be arranged such that the paper sheets 60 are easily removed and replaced by new sheets with updated menu items. The paper sheets 60 and clear sheets 58 may be eliminated by directly printing or otherwise inscribing information directly on to both sides of the double-sided luminescent film 54. The information can be inscribed such that the information is easily removed and updated as needed.

Although this disclosure describes the inventive features as applied to backlit restaurant menus 10 and 50 used in dimly lit restaurants, the invention is not limited to such an embodiment. The invention is application to a multitude of other embodiments, such as for example, wine lists, presentation notebooks, note binders, or any other embodiment where written documents, artwork, illustrations, and the like are viewed in a dimly lit or unlit environment.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A document illuminator comprising:

first and second cover portions connected along a spine portion, the first and second cover portions being foldable such that a first display surface of the first cover portion faces a second display surface of the second cover portion when the document illuminator is in a closed position;

first and second illumination sources each secured to a corresponding one of the first and second display surfaces;

a power source electrically connected to the first and second illumination sources to selectively power the first and second illumination sources when a power switch is activated; and first and second transparent sleeves secured to a corresponding one of the first and second display surfaces such that each of the first and second sleeves covers a corresponding one of the first and second illumination sources, wherein each of the first and second transparent sleeves is configured to secure a document between the corresponding illumination source and the sleeve;

wherein when first and second translucent documents are secured to corresponding ones of the first and second display surfaces by corresponding ones of the first and second transparent sleeves and power is supplied to the first and second illumination sources, each of the first and second illumination sources direct illumination through both a corresponding one of the first and second translucent documents and a corresponding one of the first and second transparent sleeves.

2. The document illuminator of claim 1, wherein the first and second illumination sources comprise electroluminescent panels.

3. The document illuminator of claim 1, further comprising a dimmer switch for selectively varying the illumination intensity of the first and second illumination sources, wherein the dimmer switch and the first and second illumination sources are configured to limit illumination intensity of the first and second illumination sources to a maximum of approximately 20 candelas per square meter.

4. The document illuminator of claim 1, further comprising a dimmer switch for selectively varying the illumination intensity of the first and second illumination sources, wherein the dimmer switch and the power source are configured to supply the first and second illumination sources with a voltage range having a minimum voltage of approximately 2.5 VDC and a maximum voltage of approximately 9 VDC.

5. The document illuminator of claim 3, wherein the dimmer switch comprises a variable resistor.

6. The document illuminator of claim 1, wherein the first and second illumination sources are configured to provide illumination at a frequency of approximately 50 Hz to approximately 60 Hz.

7. The document illuminator of claim 3, wherein the power switch is configured to be automatically activated to supply power to the first and second illumination sources when the first and second cover portions are unfolded from the closed position to an open position.

8. The document illuminator of claim 1, wherein the power source comprises a rechargeable battery.

9. A document illuminator comprising:

first and second cover portions connected along a spine portion, the first and second cover portions being foldable such that a first display surface of the first cover portion faces a second display surface of the second cover portion when the document illuminator is in a closed position;

at least one page portion connected with the spine portion such that the page portion is disposed between the first and second display surfaces when the document illuminator is in the closed position, the at least one page portion comprising:

a frame member connected with the spine portion;

an electroluminescent panel secured to the frame member;

first and second transparent sheets secured to first and second sides of the frame member; and first and second translucent documents secured against first and second sides of the electroluminescent panel; and a power source electrically connected to the electroluminescent panel to selectively power the electroluminescent panel when a power switch is activated;

wherein when power is supplied to the electroluminescent panel, the electroluminescent panel directs illumination through both of the first and second translucent documents and through both of the first and second transparent sheets.

10. The document illuminator of claim 9, further comprising a first illumination source secured to the first display surface for illuminating a translucent document secured to the first display surface.

11. The document illuminator of claim 10, wherein the first illumination source comprises an electroluminescent panel.

12. The document illuminator of claim 9, further comprising a dimmer switch for selectively varying the illumination intensity of electroluminescent panel.

13. A method for illuminating a document in an environment having reduced ambient lighting, the method comprising:

providing a document illuminator comprising first and second cover portions connected along a spine portion, first and second electroluminescent panels each secured to a corresponding one of the first and second cover portions, first and second transparent sleeves each covering a corresponding one of the first and second electroluminescent panels, and a battery electrically connected to the first and second electroluminescent panels through a power switch;

securing first and second documents between corresponding ones of the first and second electroluminescent panels and the first and second transparent sleeves, such that each of the first and second documents covers at least a portion of a corresponding one of the first and second electroluminescent panels; and activating the power switch, such that the battery supplies power to the first and second electroluminescent panels to illuminate the first and second.

14. The method of claim 13, wherein the document illuminator is configured to limit illumination intensity to a maximum of approximately 20 candelas per square meter.

15. The method of claim 14, wherein the battery is configured to provide continuous illumination for no more than two hours before needing to be recharged.

16. The method of claim 14, wherein the power switch is configured to be automatically activated to supply power to the first and second electroluminescent panels when the first and second cover portions are unfolded from a closed position to an open position.

17. The method of claim 14, wherein the document illuminator further comprises a dimmer switch for selectively varying the illumination intensity of the first and second illumination sources.

18. The method of claim 17, wherein the dimmer switch and the rechargeable battery are configured to supply the first and second electroluminescent panels with a voltage range having a minimum voltage of approximately 2.5 VDC and a maximum voltage of approximately 9 VDC.

19. A document illuminator comprising:

first and second cover portions connected along a spine portion, the first and second cover portions being foldable such that a first display surface of the first cover portion faces a second display surface of the second cover portion when the document illuminator is in a closed position;

first and second illumination sources secured to a corresponding one of the first and second display surfaces;

a dimmer switch for selectively varying the illumination intensity of the first and second illumination sources, wherein the dimmer switch and the first and second illumination sources are configured to limit illumination intensity of the first and second illumination sources to a maximum of approximately 20 candelas per square meter;

a power source electrically connected to the first and second illumination sources to selectively power the first and second illumination sources when a power switch is activated; and first and second transparent sleeves secured to a corresponding one of the first and second display surfaces such that each of the first and second sleeves covers a corresponding one of the first and second illumination sources;

wherein when first and second translucent documents are secured to corresponding ones of the first and second display surfaces by corresponding ones of the first and second transparent sleeves and power is supplied to the first and second illumination sources, each of the first and second illumination sources direct illumination through both a corresponding one of the first and second translucent documents and a corresponding one of the first and second transparent sleeves.

* * * * *